United States Patent [19]

Burns

[11] Patent Number: 4,504,984

[45] Date of Patent: Mar. 19, 1985

[54] TWO-STAGE TOILET FLUSH VALVE ASSEMBLY

[76] Inventor: John W. Burns, R.D. #2, Box 159, Summerville, Pa. 15864

[21] Appl. No.: 321,315

[22] Filed: Nov. 13, 1981

[51] Int. Cl.[3] ..... E03D 1/14; E03D 3/12

[52] U.S. Cl. ..... 4/326; 4/324; 4/325

[58] Field of Search ..... 4/324, 325, 326

[56] References Cited

U.S. PATENT DOCUMENTS

| | | | |
|---|---|---|---|
| 1,767,043 | 6/1930 | Blaun et al. | 4/326 |
| 3,768,103 | 10/1973 | Robinson | 4/326 |
| 4,011,604 | 3/1977 | Goldsworthy | 4/326 |
| 4,110,850 | 9/1978 | Tedei | 4/326 |
| 4,122,564 | 10/1978 | Addicks et al. | 4/326 |
| 4,172,299 | 10/1979 | del Pozo | 4/326 |
| 4,173,801 | 11/1979 | Bresnyan | 4/326 |
| 4,353,138 | 10/1982 | Bell | 4/326 |

*Primary Examiner*—Henry K. Artis
*Attorney, Agent, or Firm*—Harvey B. Jacobson

[57] ABSTRACT

Pivoted flap valves are positioned at different angles by valve seats formed on a flush valve body on opposite sides of a vertical axis extending through a lower outlet section of the valve body. Flexible actuating elements depending at different angles from the flush lever, control opening of the flap valves in a one- or two-stage flush operation in response to displacement of the flush lever in one direction.

5 Claims, 5 Drawing Figures

TWO-STAGE TOILET FLUSH VALVE ASSEMBLY

BACKGROUND OF THE INVENTION

This invention relates to toilet flush valve systems of the type through which two different flush volumes of water may be released in order to evacuate a toilet bowl.

Toilet bowl flush systems of the foregoing type enabling the user to select two different quantities of flushing water, have already been devised in connection with water conservation programs. However, such prior dual volume flushing systems usually create certain drawbacks insofar as operational reliability and manufacturing costs are concerned.

According to one known type of dual volume flushing system, the usual flush control lever associated with the flush tank is displaceable in opposite directions from a center position in order to select the volume of flush water to be utilized. Aside from the operational uncertainty created by such a control arrangement, a substantial linkage complexity is introduced as well as an increase in manufacturing costs. Examples of such dual volume flushing systems are disclosed, for example, in U.S. Pat. Nos. 4,096,591 and 4,172,299.

Another type of dual volume flushing system wherein the flush control lever is displaced in one direction only for a sequential two-stage flush operation, is disclosed in U.S. Pat. No. 3,768,103. According to the latter patent, two pivoted flap valves are located on one side of a vertical outlet tube directly below each other. A single actuating chain interconnects both flap valves with the flush lever. The control arrangement in such case makes operation difficult and unreliable.

It is therefore an important object of the present invention to provide a flush valve assembly of reduced cost for a dual volume flushing system of the latter mentioned type which provides for a smoother and more reliable flush operation utilizing either a smaller or larger flushing volume of water in a more facile manner.

SUMMARY OF THE INVENTION

In accordance with the present invention, two pivoted flap valves are supported in closed positions at different angles on a valve body configured to conduct uniform and non-turbulent flow of flushing water to a lower outlet section from two valve seat openings located on opposite sides of a vertical axis extending through the outlet section. Two separate flexible force transmitting elements in the form of actuating chain sections depending from the flush lever are interconnected with the flap valves independently of each other. The chain section interconnecting the flush lever with the upper flap valve in its closed position, is substantially aligned with the vertical axis through the outlet section in a taut condition, while the other actuating chain section extends at an angle to the vertical axis to the lower closed flap valve in a slack condition. Initial upward displacement of the flush lever during a first operational stage opens the upper flap valve while merely taking up the slack in the actuating chain section for the lower flap valve. A relatively small manual effort is thus required for the first stage operation producing a small volume flush. A greater manual effort required to open the lower flap valve for a large volume flush is sufficiently different from the first stage effort to provide a definite feel felt by the user to enable sensing of the end of the first stage operation without initiating any unintentional second stage operation.

First stage operation is characterized by displacement of the upper flap valve through a precise arcuate stroke of the flush lever terminated by the actuating chain section for the lower flap valve attaining a taut condition to impose a sudden increase in resistance to further pivotal displacement of the flush lever in the same angular direction. The abrupt increase in resistance to continued movement of the flush lever results from the lower flap valve being disposed at a smaller acute angle to the vertical axis than the upper flap valve and the angular relationship of the actuating chain section to the vertical axis through which an opening force is transmitted to the lower flap valve. Thus, opening of the lower flap valve during a second operational stage following the first stage is effected by an abrupt increase in the manual force applied to the flush lever. In view thereof, overtravel of the lower flap valve that may occur but is prevented by a limit stop formation on the valve body located between the two valve seat portions.

The valve body is cast in one piece with the outlet section and an overflow tube, and extends transversely of and at a general incline to the outlet section for efficient spatial distribution within the flush tank and to avoid flow turbulence therein.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENT

Figure 1:
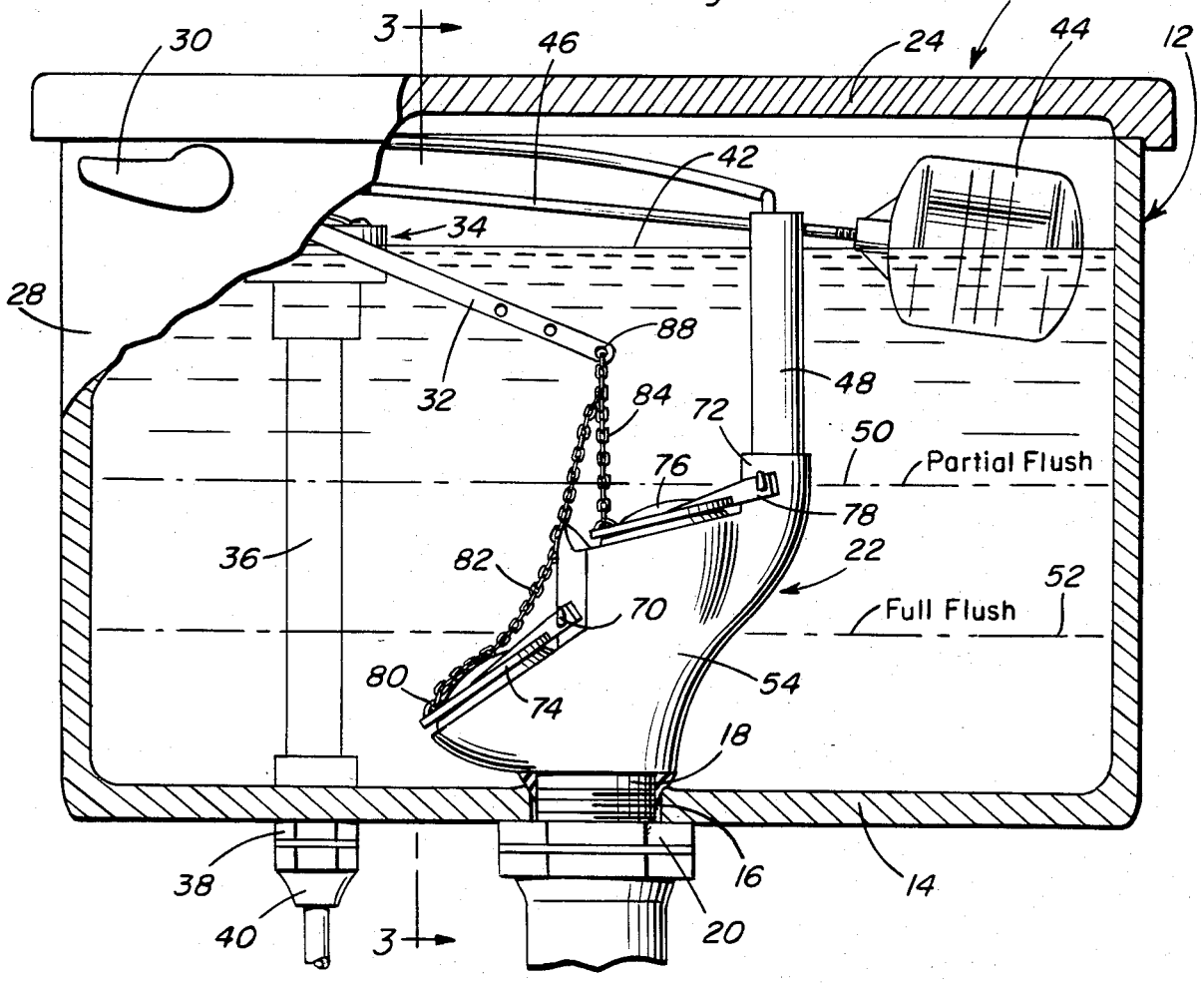
FIG. 1 is a side elevation view of a toilet flush tank, with parts broken away and shown in section revealing a flush valve assembly installed therein in accordance with the present invention.
Figure 2:
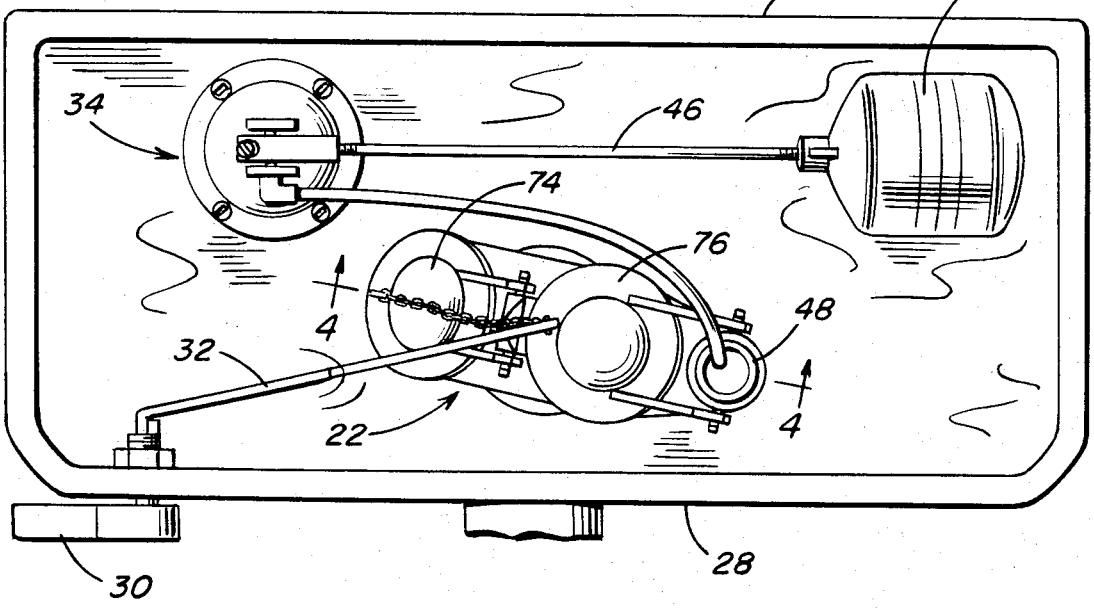
FIG. 2 is a top plan view of the flush tank shown in FIG. 1 with the cover removed.
Figure 3:
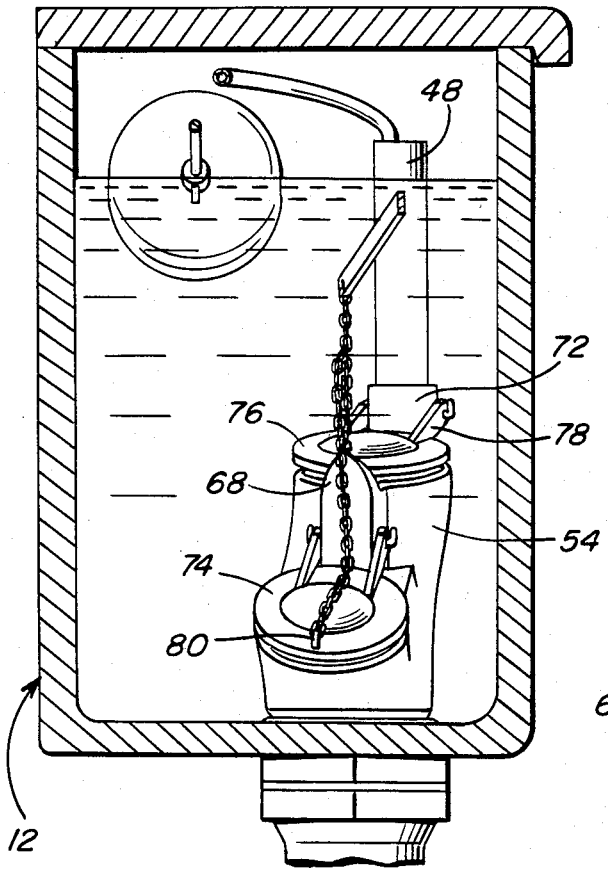
FIG. 3 is a transverse section view taken substantially through a plane indicated by section line 3—3 in FIG. 1.

Referring now to the drawings in detail, a toilet flush system generally referred to by reference numeral 10 is shown in FIG. 1. The flush system includes a conventional flush tank 12 having a bottom wall 14 provided with a central opening 16 through which a tubular outlet section 18 extends, the outlet section being externally threaded so as to threadedly receive a jam nut 20 in abutment with the bottom wall 14 to hold a flush valve assembly 22 in position within the interior of the tank 12. A conventional cover 24 is removably supported on the opened upper end 26 of the tank. The front side face 28 of the tank mounts adjacent an upper end corner portion, a conventional type of flush control lever arm 30.

Except for the valve assembly 22 and its associated actuating means, the toilet flush system 10 hereinbefore described is conventional. As part of such a conventional toilet flush system, a flush lever 32 is connected to the flush control arm 30 and is pivotally displaceable thereby within the tank 12. A conventional fill valve 34 is mounted on top of a vertical inflow tube 36 extending from the bottom wall 14 of the tank to which it is secured by a jam nut 38. The inflow of flush water is conducted through the lower projecting inlet end portion 40 of the fill tube 36. The fill valve is closed when the water within the tank reaches a normal water level 42. Such closing of the fill valve 34 is effected by means of a conventional float 44 mounted at the end of a valve operating lever element 46. It will be apparent that a toilet flush operation is initiated by opening of the flush valve assembly 22 in response to upward displacement of the flush lever 32 causing the water level within the tank to drop. The float lever 46 will accordingly also drop and thereby open the fill valve 34 causing an inflow of water until the valve assembly 22 is closed when the water level returns to the normal upper lever 42. Any unintentional overfill of the tank is prevented by overflow into the upper end of a vertical overflow tube 48 associated with the flush valve assembly 22.

In accordance with the present invention, the water within the tank drops to either a partial flush level 50 or a full flush level 52 in response to upward displacement of the flush lever 32 in the same direction through a small or larger stroke under control of a manual force applied to the flush control arm 30. The flush valve assembly 22 as more clearly seen in FIGS. 1 and 4 includes a valve body generally referred to by reference numeral 54 formed integrally with the externally threaded outlet section 18 aforementioned and extending transversely thereof at a general incline to the horizontal. The overflow tube 48 extends vertically from a portion 72 of the valve body 54 in parallel spaced relationship to a vertical axis 56 extending through the outlet section 18 between the tube 48 and the flush lever 32. A smoothly curved wall portion 58 of the valve body extends between the overflow tube 48 and the outlet section 18 on one side of the vertical axis 56 while a curved wall portion 60 extends from the outlet section on the other side of the axis 56 upwardly toward a lower valve seat portion 62 of the valve body. The valve seat portion 62 surrounds an opening in a plane at an acute angle to the vertical axis 56. An upper valve seat portion 64 is formed on the valve body 54 in a plane at a less acute angle to the vertical axis 56 surrounding an opening in the valve body located between the vertical axis and the overflow tube 48. An upper intermediate portion 66 of the valve body is disposed between the two valve seat portions 62 and 64 and includes an upwardly projecting stop formation 68. Pivot supporting formations 70 project laterally from the valve body portions 66 and 72 just above the valve seat openings in order to pivotally mount a pair of conventional flapper-type valve elements 74 and 76. Each of the flapper valve elements is provided with a pair of parallel spaced support arms 78 in pivotal engagement with the pivot support formations 70 while anchors 80 are formed on the flapper valve elements for respective connection to flexible force transmitting elements 82 and 84 in the form of actuating chain sections.

In the closed condition of the flush valve assembly as shown in FIGS. 1–4, the flush lever 32 is in its lower position with the chain section 84 suspended taut from a location 88 on the flush lever in substantial alignment with the vertical axis 56. The chain section 82 on the other hand is suspended from the same location 88 at an angle to the axis 56 and in a slack condition. Thus, initial upward pivotal displacement of the flush lever during a first operational stage through a relatively short and precise stroke, will cause upward pivotal displacement of the upper valve element 76 to an open position as shown in FIG. 5. Such movement of the flush lever takes up the slack in the chain section 82 at which point movement may be terminated without opening the lower valve element 74 upon the sensing of an abruptly increased resistance to continued movement. Accordingly, the water within the tank will drain through the valve body 54 to the partial flush level 50 just above the opening through the upper valve seat portion 64. Continued upward displacement of the flush lever during a second operational stage under a necessarily increased manual force will cause upward pivotal displacement of the valve element 74 to an open position causing further drain and flushing of water to the lower full flush level 52 located just above the opening in the lower valve seat portion 62. Upward pivotal displacement of the lower valve element 74 during the second stage is limited by the stop formation 68, aforementioned, from which limit position the lower valve element will readily drop under gravitational urge upon release of the flush control arm 30, causing downward pivotal displacement of the flush lever 32 to the valve closing position shown in FIGS. 1–4.

Figure 4:
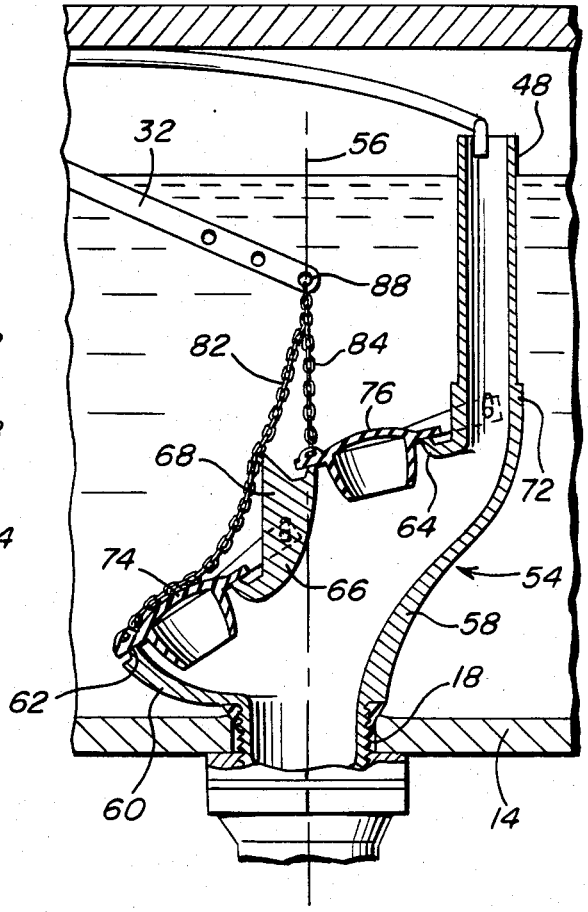
FIG. 4 is a partial side section view taken substantially through a plane indicated by section line 4—4 in FIG. 2.
Figure 5:
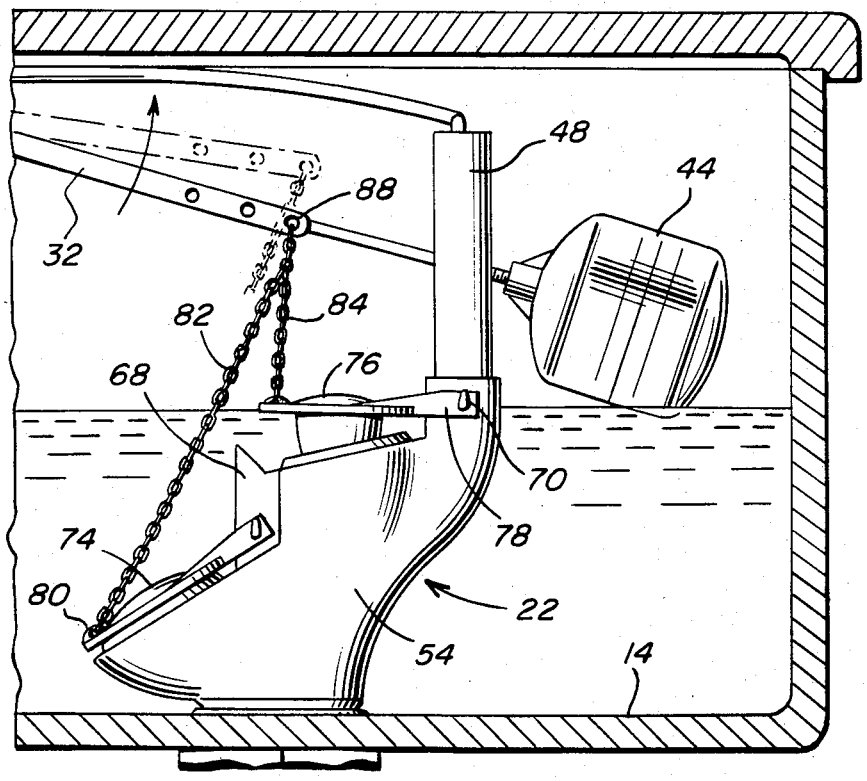
FIG. 5 is a partial side elevation view similar to that of FIG. 1, showing the flush valve assembly in a partial flush stage of operation.

As will be apparent from FIG. 4, the shape of the valve body 54 is such as to present substantially equal water flow areas for flushing flows through one or both of the valve seat openings as well as to avoid any water turbulence. Further, the taut chain section 84 is substantially aligned with the vertical axis 56 to insure initial opening of the upper valve element 76 under a relatively low manually applied force. The manual force required to cause opening of the lower valve 74, on the other hand, is substantially higher in view of the angular relationship of the chain section 82 to the vertical axis 56 and the angular disposition of the lower flap valve 74. Thus, a definite difference in feel is sensed by the user when operating the flush valve assembly in either the partial flush, single-stage mode of operation or the full flush, two-stage mode of operation so that water volume selection is made with greater confidence and reliability.

Although both chain sections 82 and 84 are shown connected to a common location on the flush lever, as an alternative the chain sections may be attached to the flush lever at spaced locations.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a dual volume flushing system having a flush tank, an outlet section through which flushing water is conducted from the tank along a vertical axis, a single valve body connected to said outlet section within the tank, a pair of vertically spaced flap valves pivotally mounted on the valve body and actuating means displaceable in one direction for selectively opening one or both of the flap valves to admit water from the tank into the valve body, the improvement residing in said valve body including valve seat portions supporting flap valves in closed positions at different angles to the vertical axis on opposite sides thereof and a single flush lever pivotally mounted within the tank operatively connected in common to both of the flush valves by the actuating means, an overflow tube connected to the valve body above said flap valves and spaced from the vertical axis opposite the flush lever, said valve body extending transversely of the outlet section and at a general incline to a plane perpendicular to the vertical axis.

2. The combination of claim 1 including stop means mounted on the valve body between the valve seat portions for preventing overtravel of the lower of the flap valves in response to said opening thereof by the actuating means.

3. The improvement of claim 4 wherein said flap valves are located on the valve body on one side of the over flow tube.

4. The improvement as set forth in claim 1 wherein said actuating means includes a chain having opposite ends connected to the flap valves, and means operatively connecting the flush lever to the chain intermediate the opposite ends thereof for opening only said one of the flap valves in response to initial displacement of the flush lever in said one direction and subsequently opening the other of the flap valves in response to continued displacement of the flush lever in said one direction.

5. The improvement as set forth in claim 4 wherein said operative connecting means includes an opening in the flush lever through which the chain is directly connected thereto.

* * * * *